US008550521B2

(12) United States Patent
Ohman, III et al.

(10) Patent No.: US 8,550,521 B2
(45) Date of Patent: Oct. 8, 2013

(54) TUBING GRAB ASSEMBLY

(76) Inventors: Roger Arthur Ohman, III, Broken Arrow, OK (US); Larry Mack Taylor, Sapulpa, OK (US)

( * ) Notice: Subject to any disclaimer, the term of this patent is extended or adjusted under 35 U.S.C. 154(b) by 1 day.

(21) Appl. No.: 13/243,527

(22) Filed: Sep. 23, 2011

(65) Prior Publication Data

US 2012/0091743 A1 Apr. 19, 2012

Related U.S. Application Data

(60) Provisional application No. 61/393,087, filed on Oct. 14, 2010.

(51) Int. Cl.
*B66C 1/00* (2006.01)
*B66C 1/48* (2006.01)

(52) U.S. Cl.
USPC ..... 294/104; 166/85.1

(58) Field of Classification Search
USPC ..... 294/101, 103.1, 104, 110.1, 114, 294/901, 902; 166/85.1, 77.51, 77.1; 24/457, 24/495
See application file for complete search history.

(56) References Cited

U.S. PATENT DOCUMENTS

| | | | | | |
|---|---|---|---|---|---|
| 900,889 | A * | 10/1908 | Schuster | 119/806 |
| 3,147,993 | A * | 9/1964 | Broderson et al. | 294/198 |
| 3,522,966 | A | 8/1970 | Wood | |
| 4,586,695 | A * | 5/1986 | Miller | 254/30 |
| 4,702,508 | A * | 10/1987 | Weiner et al. | 294/101 |
| 5,141,276 | A | 8/1992 | McClure | |
| 5,340,181 | A * | 8/1994 | Matsuyama | 294/82.33 |
| 5,409,280 | A | 4/1995 | Hill | |
| 5,984,025 | A | 11/1999 | Phillips | |
| 6,327,756 | B1 * | 12/2001 | Maziere | 24/495 |
| 7,255,381 | B2 * | 8/2007 | Komizo et al. | 294/101 |

* cited by examiner

*Primary Examiner* — Stephen Vu
(74) *Attorney, Agent, or Firm* — Head, Johnson and Kachigian, P.C.

(57) ABSTRACT

A tubing grab assembly to retain and lift tubing, pipes, tubulars or other cylindrical objects. The assembly includes a pair of opposed jaws and a housing having a cavity. A least one of the opposed jaws has a shaft therethrough to permit rotation of the jaw with respect to the housing between a closed position and an open position. A jaw spring forces the movable jaw toward the closed position. A retractable spring trigger mechanism locks the pair of opposed jaws in the closed position.

18 Claims, 5 Drawing Sheets

TUBING GRAB ASSEMBLY

BACKGROUND OF THE INVENTION

1. Field of the Invention

The present invention relates to a tubing grab assembly in order to grab, secure, lift and move a wide variety of tubing, pipes, tubulars or other cylindrical objects.

2. Prior Art

There are a number of applications that utilize metal tubing, pipes or tubulars which are connected to each other end to end. One application would be a pipeline for transportation of liquids or gases which is assembled from multiple sections. In another application, various liquids or gases are distributed through networks of pipes. In yet another application, a plurality of tubing is connected end to end for subterranean downhole exploration drilling and production activities. When a drill is lowered, successive sections of tubing are connected to the drill bit and lowered into a well. When the drill bit requires changing, the entire process is reversed. The tubing sections are often stored near the drilling operations in the horizontal position on the ground or on racks.

The sections of tubing are connected in a number of way. For threaded tubing, one end of each tubing contains an external threaded end while the opposed end contains an enlarged end with internal threads. Other connections include flanged ends which arc bolted or fastened together.

Various existing types of mechanisms are utilized at present to grab or clamp and then lift the tubing. For example, scissor type devices of various sorts are known and utilized.

The present invention provides a light, compact and portable assembly to easily secure to tubing, pipes or tubulars in order to move the tubing from a horizontal to a vertical orientation and vice versa.

The present invention also provides a tubing grab assembly that may be lowered and automatically clamped onto a tubing, pipe or tubular.

The present invention also provides a tubing grab assembly requiring no other tools to operate.

BRIEF DESCRIPTION OF THE DRAWINGS

FIG. 3 illustrates a perspective view of a first preferred embodiment of the tubing grab assembly while

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 2:
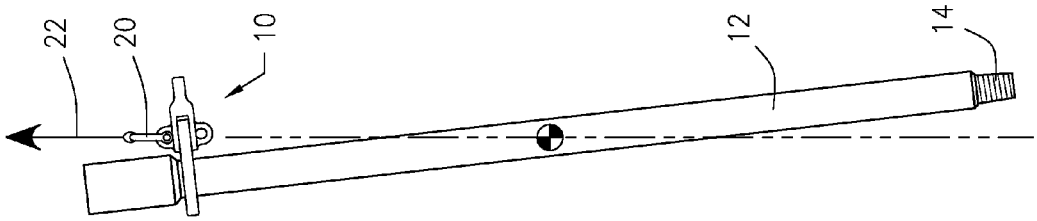
FIGS. 1 and 2 illustrate the sequential use or operation of a tubing grab assembly constructed in accordance with the present invention.
Figure 1:
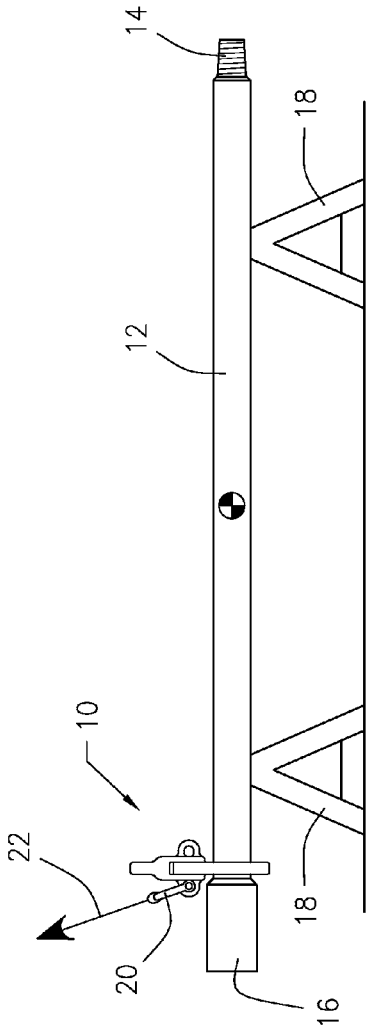

Referring to the drawings in detail, FIGS. 1 and 2 illustrate the use or operation of a tubing grab assembly 10 of the present invention. The tubing grab assembly 10 may be utilized to grab, secure, lift and move a wide variety of flanged tubing, tubulars, pipes or other cylindrical objects. As seen in FIGS. 1 and 2, one type of flanged tubing 12 includes an end 14 with external threads and an opposed, enlarged end 16. The enlarged end 16 has internal threads to mate with an adjacent tubing section and has an outside diameter larger than the diameter of the tubing. Accordingly, the transition between the tubing 12 and the enlarged flanged end 16 forms an interference or shoulder.

The tubing grab assembly 10 of the present invention is utilized to move the tubing 12 from a substantially horizontal position to a substantially vertical orientation. The tubing 12 is often stored or transported in a horizontal position. FIG. 1 illustrates the tubing 12 in a horizontal position on a rack 18. As will be described in detail herein, the tubing grab assembly 10 is brought and secured to outer circumference of the tubing.

In order to move the tubing 12 from a horizontal position shown in FIG. 1 toward the vertical position shown in FIG. 2, the tubing grab assembly 10 will be brought to and then installed around the tubing 12 as will be described herein. Either before the tubing grab assembly 10 is secured to the tubing or after, a hook or shackle 20 will be connected to the tubing grab assembly 10. The shackle 20 will, in turn, be connected to a wire line, rope, or other hoisting device (not shown) in order to lift the tubing grab assembly 10 and the accompanying tubing 12 in the direction illustrated by arrow 22.

As the tubing 12 is transitioned from horizontal to vertical, the enlarged end 16 acts as an interference to prevent the tubing grab assembly 10 from moving axially along the tubing and slipping off.

FIG. 2 shows the tubing grab assembly 10 with the tubing in a substantially vertical orientation.

Figure 3:
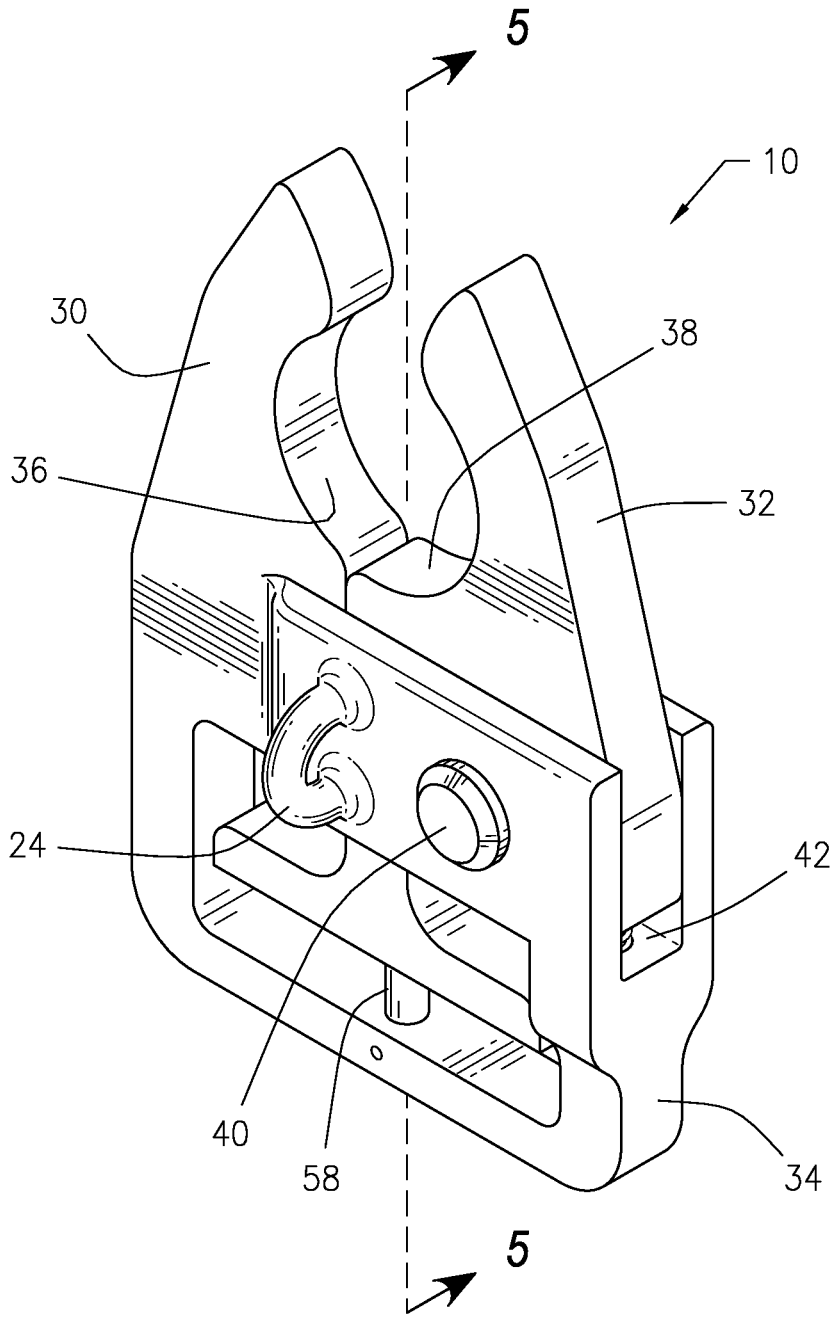
Figure 4:
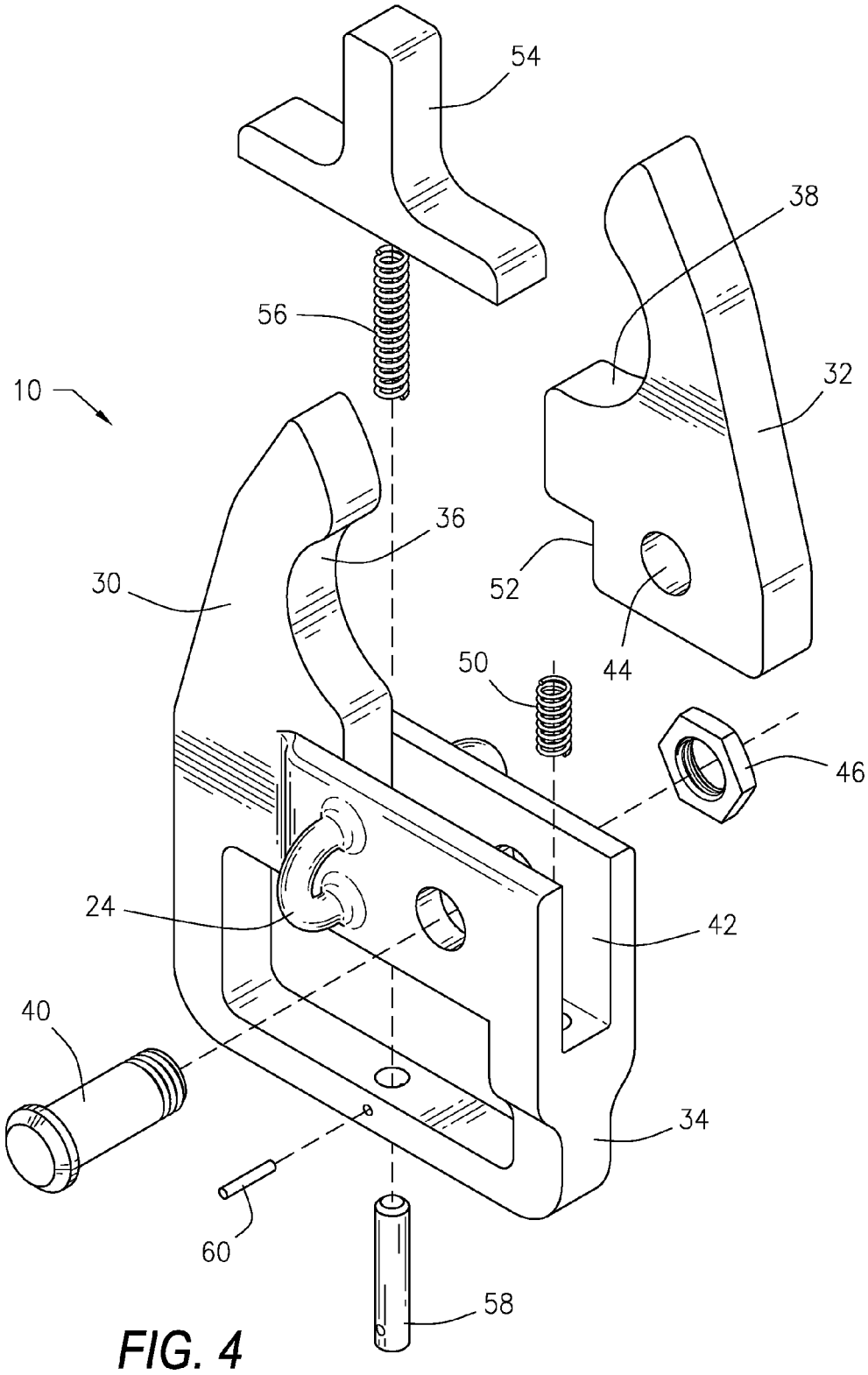
FIG. 4 illustrates an exploded view of the tubing grab assembly shown in FIG. 3.

FIG. 3 illustrates a perspective view of a first preferred embodiment of the tubing grab assembly 10 while FIG. 4 illustrates an exploded view of tubing grab assembly 10 shown in FIG. 3.

The tubing grab assembly 10 includes a pair of opposed jaws 30 and 32. In the first preferred embodiment shown in FIGS. 3 and 4, one of the jaws 30 is integral with a housing 34. Both jaws 30 and 32 have gripping edges 36 and 38, respectively, which will mate with the outside surface of the tubing 12 (not shown in FIG. 3 or 4). The gripping edges 36 and 38 may be arcuate as shown, may have teeth (not shown), or may be angular (not shown).

At least one of the opposed jaws is permitted to rotate with respect to the housing 34. The jaw 32 has a shaft 40, bolt or pin which passes through a cavity 42 in the housing 34 and through an opening 44 in the jaw 32. A nut 46 secures the bolt 40 in place. The bolt 40 acts as an axis around which the jaw 32 rotates. Other types of shaft mechanisms may be employed within the spirit or scope of the present invention.

The jaw 30 is stationary and the jaw 32 rotates between a normally closed position shown in FIG. 3 and an open position.

A coil jaw spring 50 is retained in a recess in the cavity 42 of the housing 34. The coil spring may be compressed under force. The coil jaw spring 50 extends from the recess and engages the jaw 32 to force the jaw 32 toward the closed position.

The tubing grab assembly 10 also includes a connection mechanism such as an eye 24 or a pair of eyes extending from opposed sides of the housing 34. The eye 24 would be utilized to connect to a shackle or hook.

The tubing grab assembly 10 also includes a spring trigger mechanism. The spring trigger mechanism includes a manually operated trigger 54 having a receptacle therein to receive a coil trigger spring 56 and a guide pin 58. The spring 56 and the guide pin 58 are axially aligned with each other. The diameter of the receptacle is slightly larger than the spring or guide pin. The spring 56 is normally extended but may be compressed under force. The guide pin 58 may be retained in the housing 34 by a lock pin 60 (visible in FIG. 4).

Figures 5A, 5B, 5C, 5D, 5E:
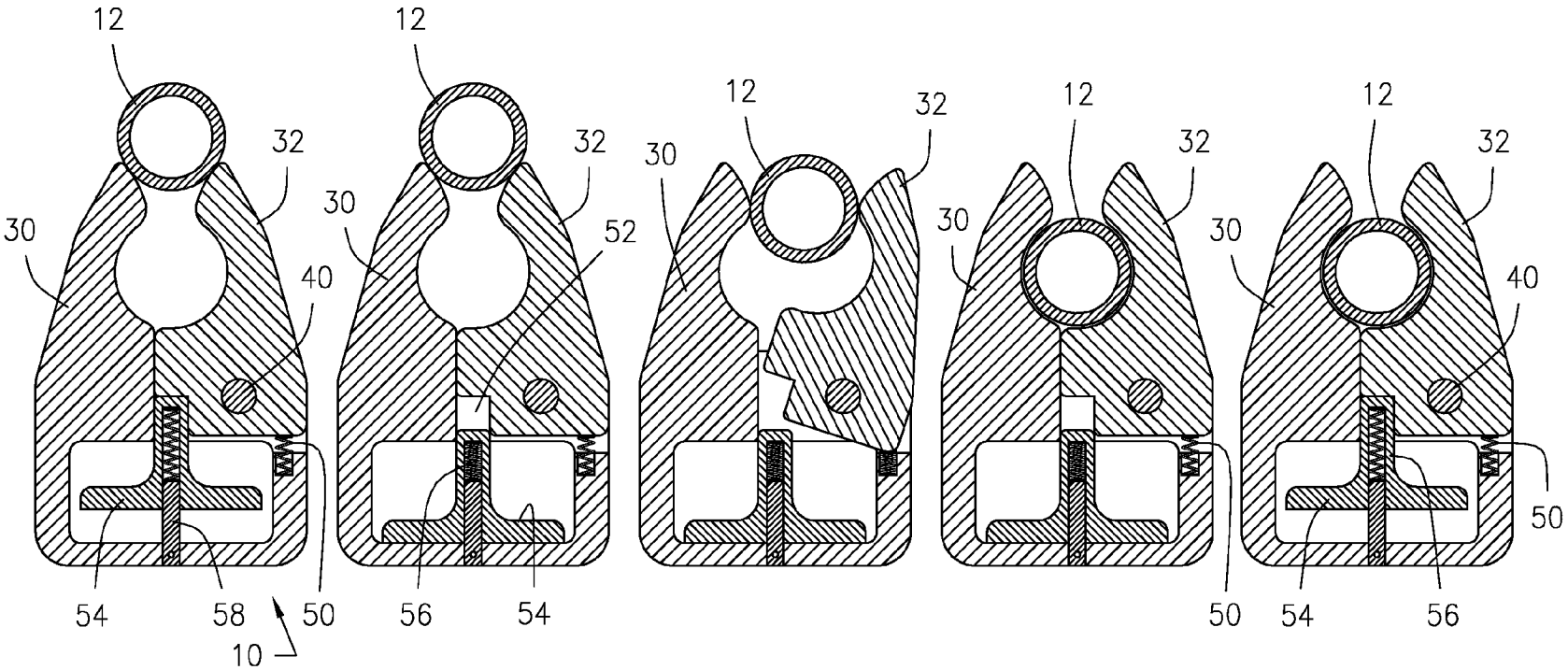
FIGS. 5A, 5B, 5C, 5D, and 5E illustrate sectional views taken along section line 5-5 of FIG. 3 showing a sequence in order to engage and retain a tubing.

FIGS. 5A, 5B, 5C, 5D, and 5E illustrate sectional views taken along section line 5-5 of FIG. 3. FIG. 5A through 5E illustrate sequential views of the tubing grab assembly 10 brought adjacent to and engaged with a tubing 12. In FIG. 5A, the jaws 30 and 32 are brought adjacent to the tubing 12 in a direction perpendicular to the axis of tubing 12. The jaws 30 and 32 are locked with respect to each other in FIG. 5A.

As seen in FIG. 5B, the trigger 54 is then manually retracted so that the coil spring 56 is compressed in the receptacle and the trigger 54 is retracted from a void portion 52 of the jaw 32. The void portion 52 of the jaw 32 together with the opposed jaw 30 forms a recess for the trigger 54 when it is extended.

When the trigger 54 has been manually retracted, the jaw 32 is no longer in the locked position. As seen in FIG. 5C, as the tubing 12 is brought into the jaws 30 and 32 or the assembly 10 is brought toward the tubing 12, the jaw 32 will be free to rotate about the bolt 40 in order to move the opposed jaws to the open position. The force of the tubing moving into the jaws 30 and 32 overcomes the force of the jaw spring 50.

As seen in FIG. 5D, once the tubing 12 is within the jaws 30 and 32, the jaw 32 will rotate about the bolt back to the closed position by force of extension of the jaw coil spring 50. Thereafter, the tubing grab assembly 10 may be placed in the locked position by releasing the trigger 54. The force of the trigger coil spring 56 urges the trigger 54 into the recess formed by the void portion 52 in the jaw 32 and the jaw 30.

Once in the position shown in FIG. 5E, the jaws 30 and 32 are locked and may not he moved. Accordingly, the grab assembly is locked to the tubing 12. The foregoing sequence may be accomplished by lowering the tubing into the jaws of the assembly or lowering the jaws of the assembly on to the tubing 12. The tubing grab assembly will be secured to the tubing adjacent the shoulder formed by the enlarged end. As the grab assembly 10 is lifted, the grab assembly 10 rests against and mates with the tubing.

FIGS. 6A, 6B, 6C, 6D, and 6E illustrate a second, alternate preferred embodiment 70 of the present invention shown in the sectional view.

The tubing grab assembly 70 includes a pair of opposed jaws 72 and 74. Each of the jaws 72 and 74 has a gripping edge 76 and 78, respectively, which mate with the outside surface of the tubing 12. The gripping edges 76 and 78 may be arcuate, may have teeth, or may be angular.

Each of the jaws 72 and 74 has a shaft, pin or bolt, 80 and 82, respectively, which passes through a cavity 84 in a housing 95. The bolts 80 and 82 also pass through openings in the jaws 72 and 74, respectively. A nut 86 and 88 secures each of the bolts 80 and 82 in place. Each bolt acts as an axis around which the jaw rotates.

Each of the jaws 72 and 74 rotates between a normally closed position and an open position. Coil jaw springs 90 and 92 are retained in recesses in a cavity 84 of the housing 95. The coil jaw springs 90 and 92 engage the jaws 72 and 74, respectively, to force them toward the closed position. The coil springs may be compressed under force.

The tubing grab assembly 70 also includes a connection mechanism, such as an eye 94 or a pair of eyes extending from opposed sides of the housing 95. The eye 94 would be used to connect to a shackle or hook.

The tubing grab assembly 70 also includes a spring trigger mechanism. The spring trigger mechanism includes a manually operated trigger 96 having a receptacle therein to receive a coil trigger spring 98 and a guide pin 100. The spring 98 and the guide pin 100 are axially aligned with each other. The diameter of the receptacle is slightly larger than the spring or guide pin. The guide pin 100 may be retained in the housing 95 by a lock pin 102.

Figures 6A, 6B, 6C, 6D, 6E:
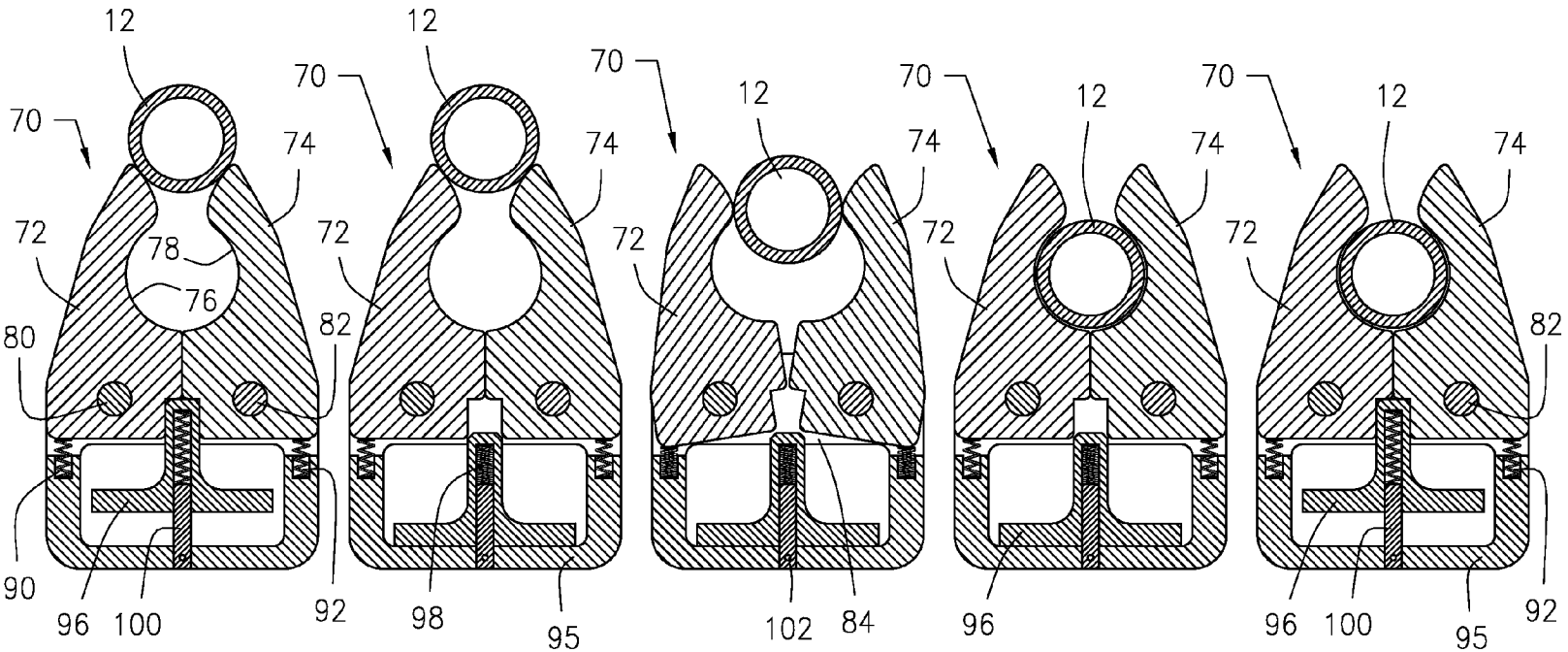
FIGS. 6A, 6B, 6C, 6D, and 6E illustrate sectional views of a second preferred embodiment of the tubing grab assembly showing a sequence to engage and retain a tubing.

FIGS. 6A, 6B, 6C, 6D, and 6E illustrate sectional views and also illustrate a sequence to engage and lock a tubing. In FIG. 6A, the locked jaws 72 and 74 are brought adjacent to the tubing 12. As seen in FIG. 6B, the trigger 96 is then manually retracted so that the coil spring 98 is compressed in the receptacle and the trigger 96 is retracted from void portions in the jaws 72 and 74 which form a recess for the trigger 96.

When the trigger 96 is manually retracted, the jaws 72 and 74 are no longer in the locked position. As seen in FIG. 6C, the jaws 72 and 74 are free to rotate about the bolts 80 and 82, respectively.

As seen in FIG. 6D, once the tubing is within the jaws 72 and 74, the jaws 72 and 74 will rotate back to the closed position by force of extension of the coil springs 90 and 92.

Thereafter, the tubing grab assembly 70 may be placed in the locked position by releasing the trigger 96. The force of extension of the trigger coil spring urges the trigger 96 into the recesses formed by the void portions in the jaws 72 and 74.

Once in the position shown in FIG. 6E, the jaws 72 and 74 are locked and may not he moved. Accordingly, the tubing 12 is locked in place.

Whereas, the present invention has been described in relation to the drawings attached hereto, it should be understood that other and further modifications, apart from those shown or suggested herein, may be made within the spirit and scope of this invention.

What is claimed is:

1. A tubing grab assembly to retain and lift tubing, which said assembly comprises:

a pair of opposed jaws;

a housing;

at least one of said opposed jaws having a shaft therethough to permit rotation of each of said at least one jaw with respect to said housing between a normally closed position and an open position, said shaft transverse to rotation of said at least one jaw;

at least one coil jaw spring which extends to force each of said at least one of said jaws toward said normally closed position; and a retractable spring trigger mechanism to lock said pair of opposed jaws in said closed position.

2. The tubing grab assembly as set forth in claim 1, including a connection mechanism to connect said housing to a hoisting device.

3. The tubing grab assembly as set forth in claim 2, wherein said connection mechanism includes an eye on each side of said housing.

4. The tubing grab assembly as set forth in claim l, wherein said housing includes a cavity to receive a portion of said at least one of said opposed jaws.

5. The tubing grab assembly as set forth in claim 1, wherein each said shaft includes a bolt passing through an opening in said housing and a nut is secured to said bolt.

6. The tubing grab assembly as set forth in claim 1, wherein said retractable spring trigger mechanism includes a trigger having a receptacle therein to receive a coil spring and a guide pin.

7. The tubing grab assembly as set forth in claim 1, wherein said at least one of said opposed jaws includes a void portion so that said pair of jaws form a recess for receipt of said trigger mechanism.

8. The tubing grab assembly as set forth in claim 1, wherein each of said pair of opposed jaws includes a void portion which together forms a recess for receipt of said trigger mechanism.

9. The tubing grab assembly as set forth in claim 1, wherein, each of said pair of opposed jaws has a shaft there though to permit rotation of each of said jaws with respect to said housing between a closed position and an open position and wherein each of said pair of opposed jaws includes one of said jaw springs to force each said jaw toward said closed position.

10. The tubing grab assembly as set forth in claim 1, wherein each of said pair of opposed jaws has an arcuate gripping edge.

11. The tubing grab assembly set forth in claim 1, wherein said tubing has an enlarged end to form a shoulder and wherein said pair of opposed jaws mates with said shoulder.

12. A tubing grab assembly to retain and lift tubing, said assembly comprises:

a pair of opposed jaws;

a housing having a cavity therein to receive a portion of said pair of opposed jaws;

at least one of said opposed jaws having a shaft therethrough to permit rotation of said at least one of said opposed jaws with respect to said housing between a normally closed position and an open position;

at least one jaw coil spring which extends to force said at least one of said jaws toward said normally closed position; and a retractable spring trigger mechanism including a trigger having a receptacle therein to receive a coil spring and a guide pin.

13. The tubing grab assembly as set forth in claim 12, including a connection mechanism to connect said housing to a hoisting device.

14. The tubing grab assembly as set forth in claim 13, wherein said connection mechanism includes an eye on each side of said housing.

15. The tubing grab assembly as set forth in claim 12, wherein said at least one of said opposed jaws includes a void portion so that said pair of jaws together form a recess for receipt of said retractable trigger mechanism.

16. The tubing grab assembly as set forth in claim 12, wherein each of said pair of opposed jaws includes a void portion which together forms a recess for receipt of said retractable trigger mechanism.

17. The tubing grab assembly as set forth in claim 12, wherein said tubing has an enlarged end to form a shoulder and wherein said pair of opposed jaws mates with said shoulder.

18. A tubing grab assembly to retain and lift tubing, said assembly comprises:

a pair of opposed jaws;

a housing;

at least one of said opposed jaws having a shaft therethough to permit rotation of each of said at least one jaw with respect to said housing between a normally closed position and an open position;

at least one coil jaw spring which extends to force each of said at least one of said jaws toward said normally closed position; and a retractable spring trigger mechanism to lock said pair of opposed jaws in said closed position, wherein said at least one of said opposed jaws includes a void portion so that said pair of jaws form a recess for receipt of said trigger mechanism.

* * * * *